US005373948A

United States Patent [19]

Nagaki

[11] Patent Number: 5,373,948

[45] Date of Patent: Dec. 20, 1994

[54] DEVICE FOR SEPARATING LONG-SIZE MATERIALS

[75] Inventor: Tsunoru Nagaki, Kitakyushu, Japan

[73] Assignee: Nippon Jiryoku Senko, Co., Ltd., Fukuoka, Japan

[21] Appl. No.: 77,447

[22] Filed: Jun. 17, 1993

[30] Foreign Application Priority Data

Sep. 16, 1992 [JP] Japan ..... 4-273856

[51] Int. Cl.[5] ..... B07B 13/05

[52] U.S. Cl. ..... 209/667; 209/668; 209/680; 209/683

[58] Field of Search ..... 209/44.3, 284, 288, 209/664, 667, 683, 687, 659, 660, 668, 680

[56] References Cited

U.S. PATENT DOCUMENTS

| | | | |
|---|---|---|---|
| 207,178 | 8/1878 | Heald | 209/683 |
| 3,389,711 | 6/1968 | Slayton | 209/683 X |
| 4,873,105 | 10/1989 | Coppolani | 209/664 X |
| 5,163,563 | 11/1992 | Coppolani | 209/664 |

FOREIGN PATENT DOCUMENTS

| | | | |
|---|---|---|---|
| 59-36580 | 2/1984 | Japan | 209/683 |

*Primary Examiner*—Robert P. Olszewski
*Assistant Examiner*—Tuan N. Nguyen
*Attorney, Agent, or Firm*—Armstrong, Westerman, Hattori, McLeland & Naughton

[57] ABSTRACT

A device for separating long-size materials included in the scraps of a crushed car, etc., has an inner cylinder which is installed with a slope and around which a plurality of short pipes are radially installed as they open to the inside of the inner cylinder, and receiving plates which are installed around the outside of said short pipes with a predetermined spacing therefrom. The inner cylinder is rotated at a low speed with the receiving plate, and the scraps charged from the upper stream of said inner cylinder are separated to the short-size materials which have passed through the short pipes and the long-size materials which have flowed down through said inner cylinder.

2 Claims, 2 Drawing Sheets

DEVICE FOR SEPARATING LONG-SIZE MATERIALS

BACKGROUND OF THE INVENTION

The present invention relates to a device for separating long-size materials such as electric wires, and the like, which are mainly included in the scraps of a crushed car, etc.

Conventionally, cars, etc., which are out of service, are crushed into small pieces of 50 to 60 mm in size by a preshredder and a shredder, and then such small pieces are separated into light and heavy scraps by use of an air-blast separator. From the heavy scraps, scrap iron is extracted by use of a magnetic separator and recovered as a resource.

Then, in the heavy scraps from which the scrap iron has been removed, there are nonferrous metals such as copper, aluminum, zinc, and stainless steel, and glass, rubber, etc., and they are further recovered as resources metal by metal by utilizing the electrical and physical properties thereof or by a manual selection, as the case may be.

However, there has been a problem that the heavy scraps from which the scrap iron has been removed include long-size materials consisting of electric wires, etc. which are cut into pieces of about 50 to 60 mm in size and, if such long-size materials are included in the scraps, they get entangled or catch other materials and interfere with succeeding processes.

The present invention has been made to solve the above-disclosed problems and has an object of providing a device for separating automatically long-size materials included mainly in scraps.

SUMMARY OF THE INVENTION

The device for separating long-size materials according to the present invention with the object mentioned above comprises an inner cylinder which is rotatably installed with a slope and around which a plurality of separation holes are formed, short pipes radially connected to the inner cylinder and which are concentric with the separation holes respectively, receiving plates installed around the outside of the inner cylinder with a predetermined spacing from the outer edge of the short pipes, and a driving means for rotating said inner cylinder together with the receiving plates.

Accordingly, when the inner cylinder is set with a proper slope and rotated by a driving means, and the scraps to be processed are charged into the inner cylinder at the upper end thereof, all of the scraps drop into the short pipes through the separation holes. The long-size material, however, is prevented from passing from the pipes because it collides with the receiving plates after having dropped into one of the short pipes and then the long-size material in the short pipe is caused drop back into the inner cylinder when the short pipe in which the long-size material is caught moves to the top position accompanying the rotation of the inner cylinder. All the long-size materials go through the same process and, after repeating such a process, they are discharged from the downstream end of the inner cylinder.

The materials which are not long in size and through the short pipes and the long-size materials that instead are moved through the inner cylinder and discharged from the downstream end thereof are thus separated.

In addition, in the case of a device for separating long-size materials according to the present invention, it is possible to install inner and outer cylinders so that they may be concentric with each other and attach receiving plates to the outer cylinder so that they may move back and forth freely between the two cylinders. This has an advantage to make it possible to adjust the length of the long-size material that is prevented from passing from the short pipes.

DESCRIPTION OF THE PREFERRED EMBODIMENT

Figure 1:
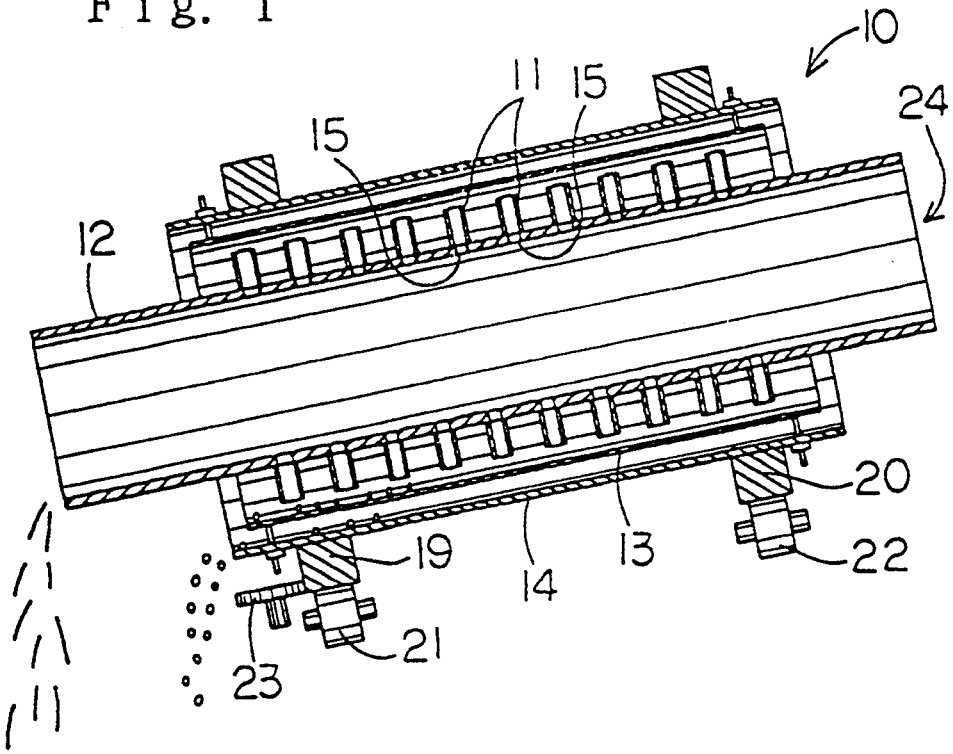
FIG. 1 is a section of a device for separating long-size materials relating to one embodiment of this invention.
Figure 2:
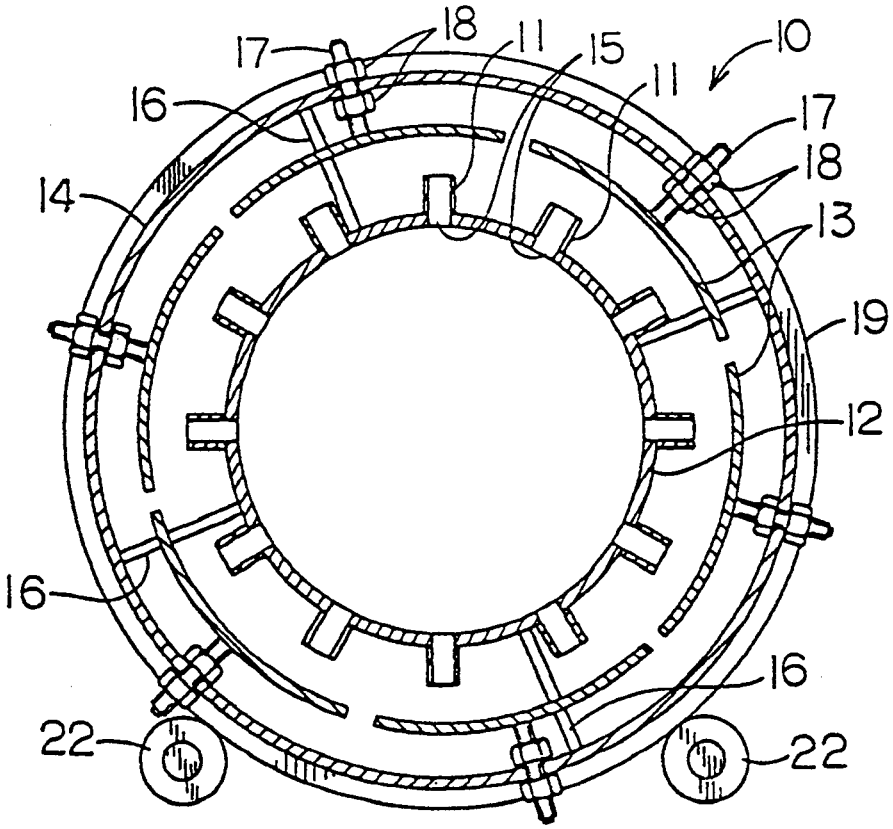
FIG. 2 is a cross section of the same.

As shown in FIG. 1 and FIG. 2, the device 10 for separating long-size materials relating to one embodiment of this invention is totally made up with a corrosion-resistant steel or stainless steel, and has an inner cylinder 12 around which a plurality of short pipes 11 are installed, receiving plates 13 installed around the outside of said inner cylinder 12, an outer cylinder 14 installed around the outside of said receiving plates 13, and a driving means for rotating these components. The details thereof will be explained hereinbelow.

Figure 3:
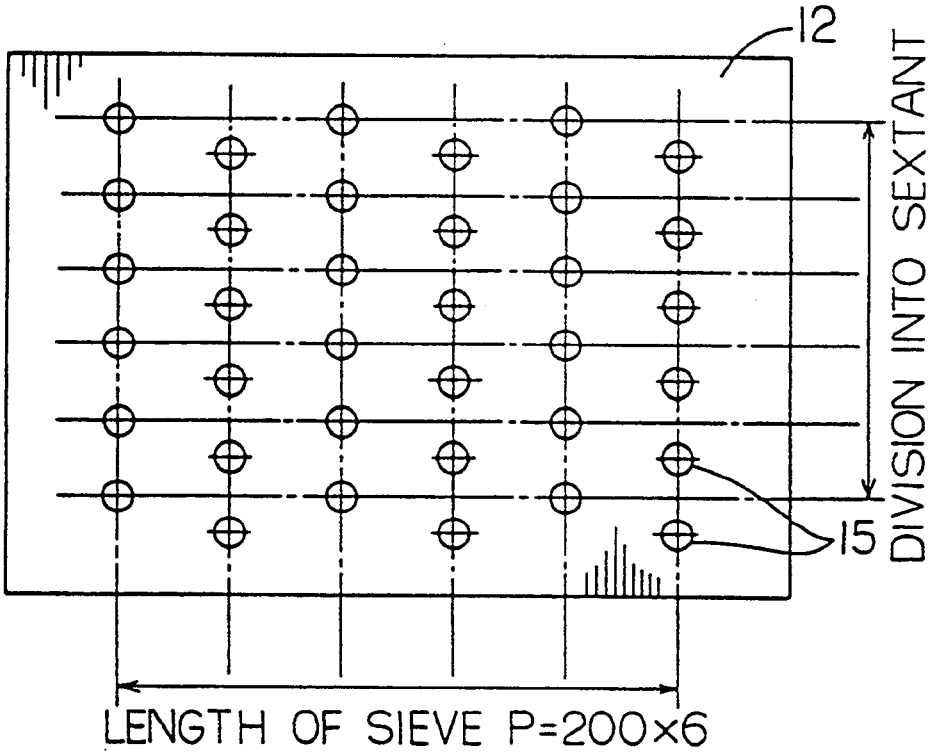
FIG. 3 is a partial development of the same.
Figure 4:
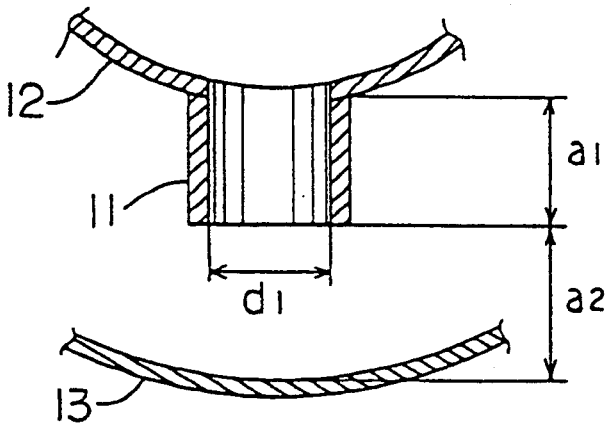
FIG. 4 is a partial enlarged view of the same.

The size of the short pipes 11 installed around the inner cylinder 12 varies depending on the kind of the scraps to be separated. For example, their inside diameter is approximately 30 to 50 mm and their length is approximately 20 to 50 mm, if said scraps are crushed into pieces of approximately 50 mm or less in size through preceding processes. The inner cylinder 12 has a plurality of separation holes 15 which are formed with a proper pitch, and each of the short pipes 11 opens to each of the separation holes 15 as shown in FIG. 3 and FIG. 4.

The inner cylinder 12 is concentrically installed in the outer cylinder 14, and the outer cylinder 14 is connected to the inner cylinder 12 at both top and tail ends by supporting members 16.

At the outside of the inner cylinder 12, receiving plates 13 are provided each of which has an arc-like cross section. At the outside of each of said receiving plates 13, bolts 17 and nuts 18 are disposed so that the receiving plates 13 may be attached to the outer cylinder 14 and be caused to move back and forth freely between the cylinders by adjusting the nuts 18.

The distance between these receiving plates 13 and each discharging port of the short pipes 11 is approximately between 20 to 450 mm, and can be varied depending on the kind of the scraps to be separated with respect to the length and the inside diameter of the short pipes 11.

Around the both ends of the outer cylinder 14, steel tires 19 and 20 are provided and, to the tire 19, a driving wheel 21 and a guide wheel 23 are contacted, and, to the tire 20, a driving wheel 22 is contacted and, by use of a motor which is not shown, said tires 19 and 20 are rotated so that the whole body of the device may rotate at 10 to 60 rpm. Because said outer cylinder 14 is given a slope of 5 to 30 degrees, the scraps charged from the upper end of the inner cylinder 12 go smoothly down toward the lower end.

Therefore, to use the device 10 for separating long-size materials, the scraps which were crushed into pieces of a predetermined size and from which scrap iron was removed by use of a magnetic separator are charged little by little from a charging port 24. Then fine scraps and those which are not long in size drop into the short pipes 11 through the separation holes 15 and flow down to the lower end through a spacing between the edge of the short pipes 11 and the receiving plates 13. Such scraps are discharged from the end of the receiving plate 13 or the downstream end of outer cylinder 14. Meanwhile the long-size materials which are longer than the spacing between the edge of the short pipes 11 and the receiving plates 13 are caught by the short pipes 11 and are impossible to flow down. Then, by the rotation of the inner cylinder 12, such long-size materials are moved around to an upper region within the pipes and, when said short pipes 11 come to the upper position and are inverted, the long-size materials drop to the lower position of the inner cylinder 12 and are caught again by the short pipes 11 at lower portion of the inner cylinder. Repeating this process, the long-size materials are discharged from the downstream end of the inner cylinder 12 which is projecting from the outer cylinder 14.

Thus, the long-size materials consisting of electric wires, etc. are separated from those which are not long in size.

In addition, Table 1 shows the result of experiment conducted at 20 rpm of inner cylinder 12 and with $a_1$, $a_2$, and $d_1$ of FIG. 4 being 45 mm, 22.5 mm, and 25.4 mm respectively.

TABLE 1

| | Weight % | Distribution | |
|---|---|---|---|
| | | 25 mm and under | Over 25 mm |
| Scraps | 100 | 70% | 30% |
| Plus sieve (Over 25 mm) | 29 | — | 99% |
| Minus sieve (25 mm and under) | 71 | 100% | 1% |

As clear as Table 1 shows, it is possible to separate long-size materials almost completely by use of the device 10 for separating long-size materials.

In the embodiment described above, the diameter and the length of the short pipes were stated but they are only examples, and the present invention is not limited to those dimensions but is applicable to the cases using other dimensions.

What is claimed is:

1. A device for separating long-size materials, comprising:

an inner cylinder which is rotatably installed on an inclined axis, and around the wall of which a plurality of separation holes are formed, short pipes radially connected to the inner cylinder, and which are concentric with respective separation holes, receiving plates disposed around the outside of the inner cylinder with a predetermined spacing from the outer edges of the respective short pipes to restrict the length of material permitted to be discharged from the short pipes, and a driving means for rotating said inner cylinder together with the receiving plates.

2. A device for separating long-size materials according to claim 1, wherein an outer cylinder is disposed in concentric relation with respect to the inner cylinder, and the receiving plates are attached to the outer cylinder for adjustment in a radial direction.

* * * * *